US006373352B1

(12) United States Patent
Lee et al.

(10) Patent No.: US 6,373,352 B1
(45) Date of Patent: Apr. 16, 2002

(54) DUPLEXER WITH STEPPED IMPEDANCE RESONATORS

(75) Inventors: Chang Hwa Lee; Meyng Soo Kim; Bon Hee Koo; Dong Suk Jun; Sang Seok Lee; Tae Goo Choy, all of Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 09/530,322

(22) PCT Filed: Apr. 2, 1998

(86) PCT No.: PCT/KR98/00078

§ 371 Date: Apr. 28, 2000

§ 102(e) Date: Apr. 28, 2000

(87) PCT Pub. No.: WO99/22417

PCT Pub. Date: May 6, 1999

(30) Foreign Application Priority Data

Oct. 28, 1997 (KR) ..... 97-55639

(51) Int. Cl.[7] ..... H01P 5/12; H01P 1/20; H01P 3/06

(52) U.S. Cl. ..... 333/134; 333/202; 333/206

(58) Field of Search ..... 333/202, 206, 333/207, 222, 202 DB, FOR 134

(56) References Cited

U.S. PATENT DOCUMENTS 5,528,204 A * 6/1996 Hoang et al. ..... 333/134
6,054,909 A * 4/2000 Lee et al. ..... 333/206

FOREIGN PATENT DOCUMENTS

JP 62-213301 * 9/1987

* cited by examiner

*Primary Examiner*—Robert Pascal
*Assistant Examiner*—Kimberly E. Glenn
(74) *Attorney, Agent, or Firm*—Antonelli, Terry, Stout & Kraus, LLP

(57) ABSTRACT

A duplexer using a dielectric block and having stepped impedance resonators is disclosed. The duplexer comprising open ended resonators arranged in a front side of the dielectric block, shorted resonators arranged in a rear side of the dielectric block, first grooves for controlling receiving coupling at the receiving filter, second grooves for controlling transmitting coupling at the transmitting filter, and a plurality of recesses formed at the bottom of the dielectric block, extending from a first aperture of the open ended resonators to a second aperture of the shorted resonators. The duplexer according to this invention is miniaturized by excluding external elements and has excellent attenuation characteristics, and is being manufactured by simple processes.

9 Claims, 11 Drawing Sheets

DUPLEXER WITH STEPPED IMPEDANCE RESONATORS

TECHNICAL FIELD

The present invention relates to a duplexer using a dielectric block and, more particularly, to a duplexer with stepped impedance resonators.

BACKGROUND ART

Recently, in radio communication systems, transmitting frequency and receiving frequency have been used in a similar band for improving usefulness of frequency. For high frequency circuits of these communication systems, transmit-receive branching filters have been widely used.

A duplexer, which is one of these transmit-receive branching filters, must have the excellent attenuation characteristics at receiving and transmitting terminals. The transmitting filter needs the excellent attenuation characteristics in the frequency band (receiving frequency band) higher than the pass band, but the receiving filter needs the excellent attenuation characteristic in the frequency band (transmitting frequency band) lower than the pass band. Further, with the miniaturization of the communication systems, small-sized and light dudlexers are required.

A conventional duplexer using a dielectric block is shown in FIG. 1, wherein the conventional duplexer is formed by an integrated structure having a dielectric block 100 and a plurality of resonators 111 to 120 formed therein. In FIG. 1, the duplexer has four resonators 111 to 114 for transmitting filters, five resonators 115 to 119 for receiving filters, and one resonator 120 for a branch circuit separating transmission signals from receiving signals.

The dielectric block 100 includes apertures corresponding to the resonators 111 to 120 and the apertures extending from one surface, that is, a top surface, to an opposite (bottom) surface, are arranged in a line in parallel with each other. All the surfaces of the dielectric block 100, except the top surface thereof, and inner surfaces of the apertures are coated with a conductive film. Then, the bottom surface of the dielectric block 100 acts as a shorted portion connected to a ground voltage level and the top surface thereof forms an open ended portion and then the aperture acts as a resonator of ¼ wavelength. Also, This resonator is the UIR (uniform impedance resonator) having the same impedance in the open ended portion and the shorted portion.

Conductive rods 131 and 141 for input and output terminals are inserted into the apertures of the first and last resonators 111 and 119, respectively, and dielectric materials 132 and 142 for a capacitive coupling are formed between the conductive film formed on the inner surfaces of the apertures and the conductive rods 131 and 141. At an antenna terminal 121, the resonator 120 is used as a branch circuit for the impedance matching in the transmitting terminal and the receiving terminal. Accordingly, an input signal, which is input into the filter of the transmitting terminal, is not transmitted to the receiving terminal but the antenna terminal 121 and an input signal from the antenna terminal 121 is not transmitted to the transmitting terminal but the receiving terminal.

In the above duplexer, the coupling between the resonators is accomplished by a single coupling line in which admittance in the odd and even modes of the open ended portion and the shorted portion is constant and, except the top surface of the dielectric block, all the surfaces thereof are coated with a conductive film.

Shown in FIG. 3 is an insertion loss characteristic graph at transmitting and receiving terminals using the duplexer of FIG. 1. As shown in FIG. 3, there is scarcely any attenuation characteristic at frequency higher or lower than its pass band.

However, in the mobile communication, the transmitting frequency band is near to the receiving frequency band for effectively using the frequency band and it is required that the band-pass filter at the transmitting terminal has the attenuation characteristics at frequency higher than the pass band width to increase the attenuation at frequency next to it. Also, the receiving terminal requires the band-pass filter to have the high attenuation characteristics at frequency lower than the pass band width.

If the number of resonators increases to improve the attenuation characteristics at this band-pass filter, the insertion loss and the size of the filter may increase. Accordingly, a filter having a pole, which cuts off signals at a specified frequency without increasing the number of resonators, has be needed.

FIG. 2 is a perspective view illustrating another conventional duplexer having shorted resonators of ¼ wavelength and massive elements such as inductor and capacitor.

Referring to FIG. 2, a filter at a transmitting terminal uses three separate resonators and a chip capacitor 211 is formed between a resonator 251 and an input terminal 231. At the transmitting terminal, the coupling between the resonators is obtained through external chip capacitors 212 and 213 which are formed on the printed circuit board (PCB) 210 and electrically connected to each other by electrical patterns formed thereon. To cut off signals at a specified frequency, a chip inductor 232 is formed at an open ended resonator 252. That is, by connecting the inductor 232 to the open ended resonator 252, the frequency, at which the impedance of the resonance circuit is "0", exists at frequency higher than the resonance frequency. At this time, since the signal from an input side flows into a ground voltage level through the resonance circuit, the pole frequency to cut off an output signal is produced. Since this pole frequency is generated at higher frequency than the pass band width of the transmitting filter, the attenuation of the receiving frequency signal may be increased.

A filter at a receiving terminal employs four separate resonators 254 to 257 and a chip capacitor 217 is formed between a resonator 257 and an output terminal 241. At the receiving terminal, the coupling between the resonators is obtained through external chip capacitors 214 to 216 which are formed on the printed circuit board (PCB) 210 and electrically connected to each other by electrical patterns formed thereon. To cut off signals at a specified frequency, a chip capacitor 242 is formed at an open ended resonator 255. Accordingly, the frequency, at which the impedance of the resonance circuit is "0", exists at frequency lower than the resonance frequency. At this time, since the signal from an input side flows into the ground voltage level through the resonance circuit, the pole frequency to cut off an output signal is produced. Since this pole frequency is generated at higher frequency than the pass band width of the received signal, the attenuation of the transmitting frequency signal may be increased.

Further, a chip inductor 222 and a chip capacitor 223 are used for matching the impedances of the antenna terminal 221 and the filters at the transmitting and receiving terminals. Accordingly, the signal which is input into an input port at the transmitting terminal is not transmitted to the filter at the receiving terminal but propagated via the antenna terminal. Also, the signal received by the antenna is transmitted to the filter at the receiving terminal so that an external energy is transferred to the receiving terminal.

FIG. 6 shows an insertion loss characteristic graph at the filter at the receiving terminal of the duplexer according to the prior art and the present invention. As shown in FIG. 6, in the duplexer according to the prior art, the attenuation characteristics are improved at the frequency band lower than the pass band width.

Although the above-mentioned duplexer improves the attenuation characteristics with the small number of resonators and the filter to have a pole, its size is large and a method for fabricating thereof is complicate because of the external elements, such as a chip capacitor and a chip inductor.

With the miniaturization of communication systems, it is required that the duplexer should be miniaturized and also that the duplexer have excellent attenuation characteristics at the frequency band lower than the pass band, so as to raise the efficiency in using frequency, by using the transmitting frequency which is in close vicinity to receiving frequency. However, because the duplexer employing the above-mentioned dielectric resonators, in the form of a monoblock type, is in need of a large number of resonators to improve the attenuation characteristics, the size of filter becomes larger. In case of the duplexer using the filter having a pole, filter's size is large and a method for fabricating thereof is complicate because of the external elements, such as a chip capacitor and a chip inductor.

DISCLOSURE OF THE INVENTION

Therefore, it is an object of the present invention to provide a miniaturized duplexer by excluding external elements, such as a chip capacitor and a chip inductor.

It is another object of the present invention to provide an improved duplexer having excellent attenuation characteristics at lower frequency band than the pass band or at higher frequency band than that.

It is further another object of the present invention to provide a duplexer capable of being manufactured by simply processes to reduce its cost.

In accordance with an aspect of the present invention, there is provided a duplexer having stepped impedance resonators which are formed in a dielectric block coated with a conductive film, wherein the duplexer includes a transmitting filter, a receiving filter and an impedance matching circuit, the duplexer comprising: a) a plurality of open ended resonators arranged in a front side of the dielectric block, the open ended resonators includes: a-1) a plurality of first apertures, each of which passes through the dielectric block from an upper surface thereof to a bottom surface thereof, wherein inner surfaces of the first apertures are coated with the conductive film; and a-2) a plurality of uncoated gaps round the first apertures on the upper surface of the dielectric block, b) a plurality of shorted resonators arranged in a rear side of the dielectric block, the shorted resonators includes: b-1) a plurality of second apertures, each of which passes through the dielectric block from the upper surface thereof to the bottom surface thereof, wherein each shorted resonators corresponds to the open ended resonators and wherein inner surfaces of the second apertures are coated with the conductive film, c) a plurality of recesses formed at the bottom of the dielectric block, extending from the first apertures of the open ended resonators to the second apertures of the shorted resonators, wherein the recesses are coated with the conductive film; d) a plurality of first grooves for controlling receiving coupling at the receiving filter, each of which is formed in the rear side of the dielectric block at the receiving filter, wherein the first grooves are formed from the upper surface of the dielectric block to the bottom surface of the dielectric block; and e) a plurality of second grooves for controlling transmitting coupling at the transmitting filter, each of which is formed in the front side of the dielectric block at the transmitting filter, wherein the second grooves are formed from the upper surface of the dielectric block to the bottom surface of the dielectric block.

In accordance with an aspect of the present invention, there is provided a duplexer having stepped impedance resonators which are formed in a dielectric block coated with a conductive film, wherein the duplexer includes a transmitting filter, a receiving filter and an impedance matching circuit, the duplexer comprising: a plurality of resonators arranged in a rear side of the dielectric block, wherein each resonators passes through the dielectric block from an upper surface thereof to a bottom surface thereof, wherein inner surfaces of the first apertures are coated with the conductive film; a plurality of recesses formed at the upper surface of the dielectric block, extending from the resonators toward a front side of the dielectric block; a plurality of first grooves for controlling receiving coupling at the receiving filter, each of which is formed in an outer wall of the dielectric block and between the resonators wherein the first grooves are formed from the upper surface of the dielectric block to the bottom surface of the dielectric block; and a plurality of second grooves for controlling transmitting coupling at the transmitting filter, each of which is formed in the upper surface of the dielectric block and between the resonators, wherein the second grooves are formed from the rear side of the dielectric block to a front side of the dielectric block.

BRIEF DESCRIPTION OF THE DRAWINGS

The nature and mode of operation of preferred embodiments of the present invention will now be more fully described in the following detailed description, taken with the accompanying drawings, in which.

BEST MODE FOR CARRYING OUT THE INVENTION

Hereinafter, a duplexer according to the present invention will be described below referring to accompanying drawings.

In radio communication systems, the duplexer, which has been used as a transmit-receive branching filter, is implemented by a coaxial dielectric resonator in a TEM mode. The number of coaxial resonators to be used is determined by the required characteristics of filter. Generally, for increasing the signal attenuation of the transmitting frequency at the band-pass filter of the receiving terminal, the number of resonators used as a filter at the receiving terminal is larger than that at the transmitting terminal.

Figure 1:
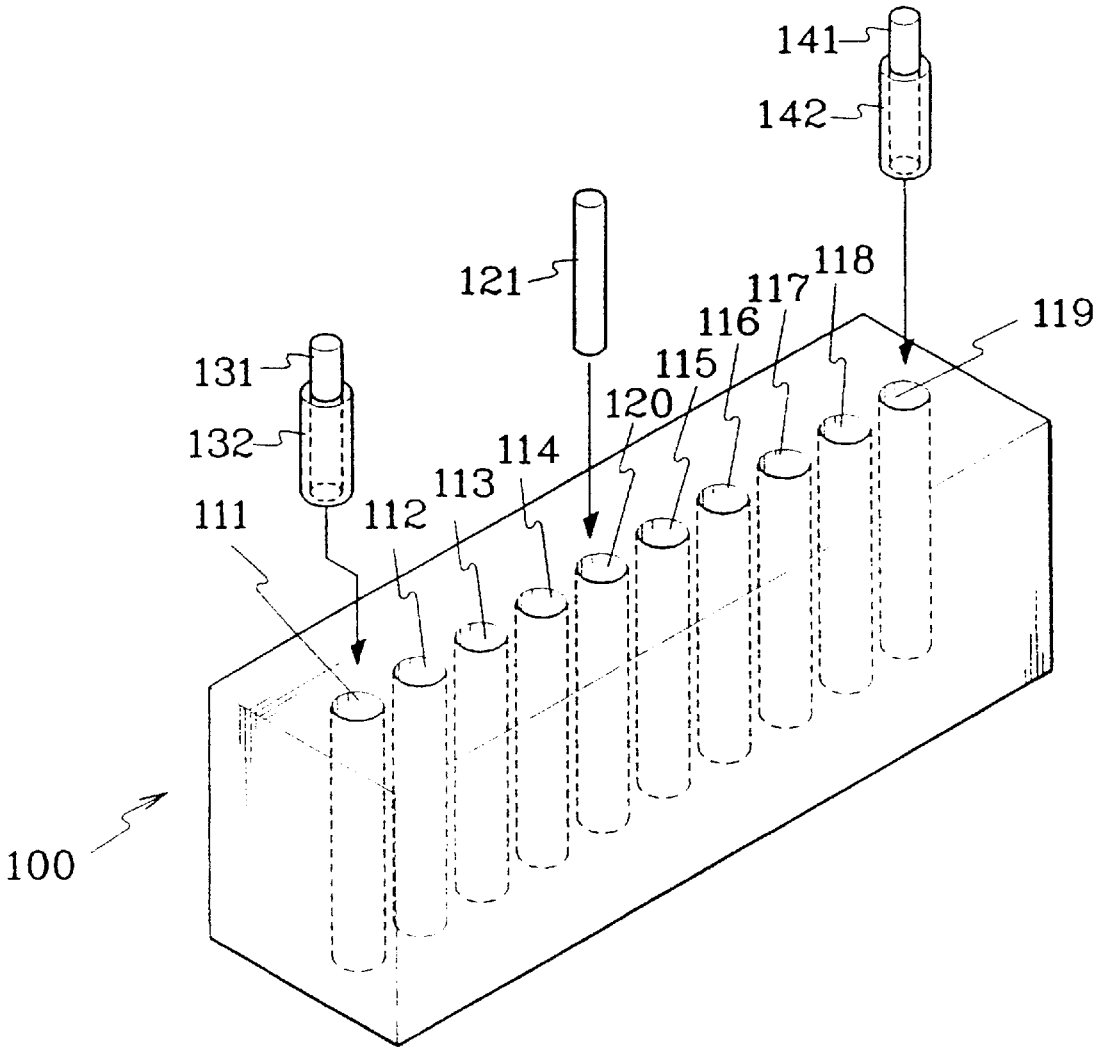
FIG. 1 (PRIOR ART)
FIG. 1 is a perspective view illustrating a conventional duplexer using a dielectric block.
Figure 2:
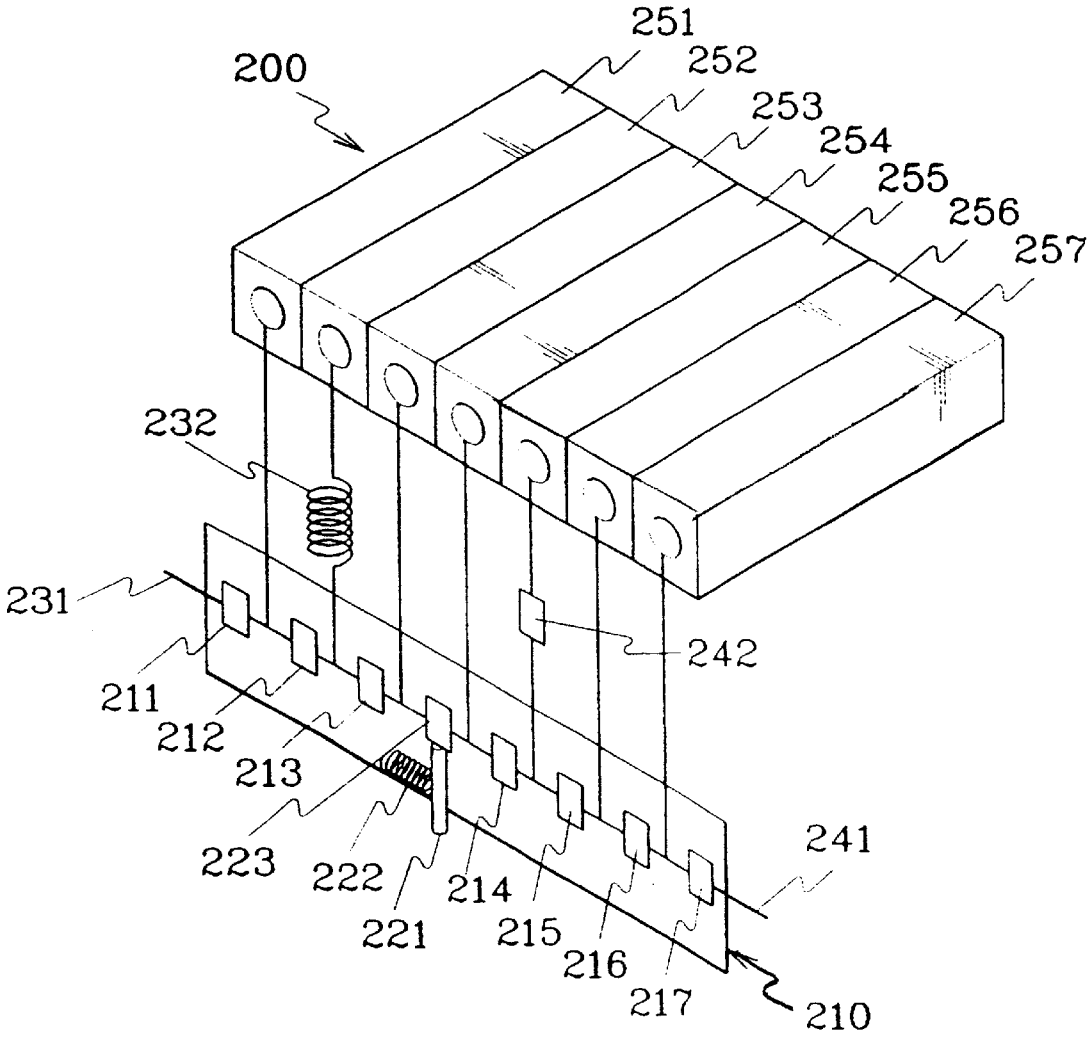
FIG. 2 (PRIOR ART)
FIG. 2 is a perspective view illustrating another conventional duplexer using a dielectric block.
Figure 3:
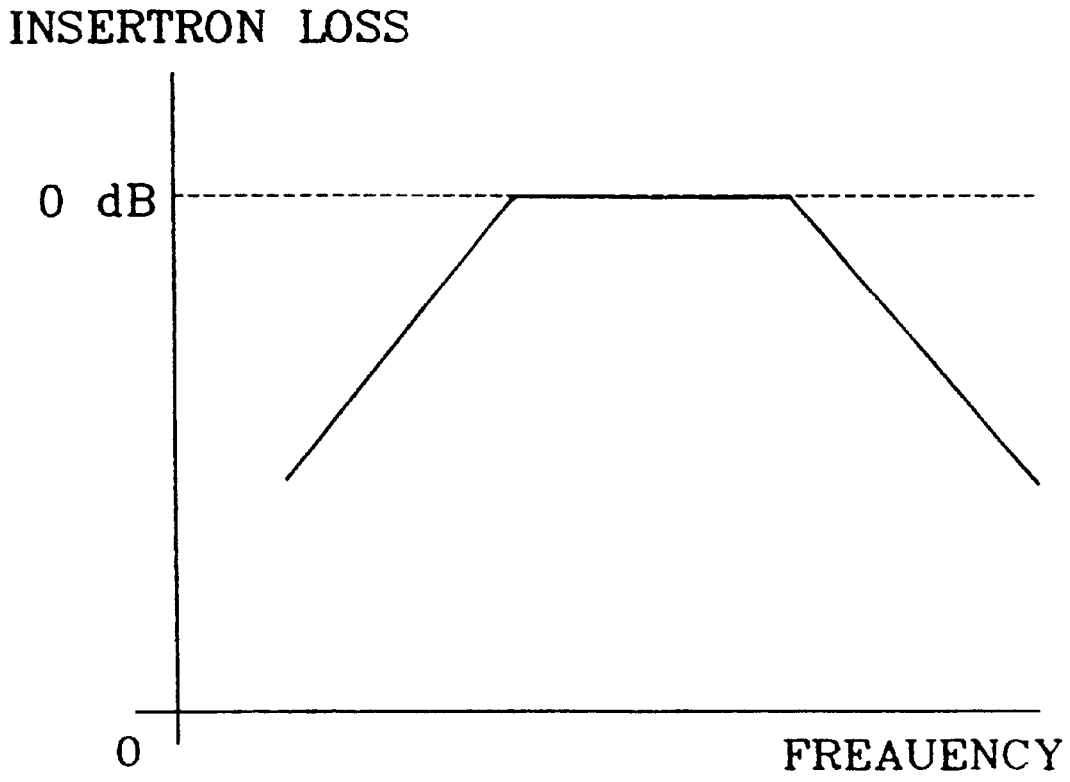
FIG. 3 PRIOR ART
FIG. 3 is an insertion loss characteristic graph at transmitting and receiving terminals using the duplexer of FIG. 1.
Figure 4A:
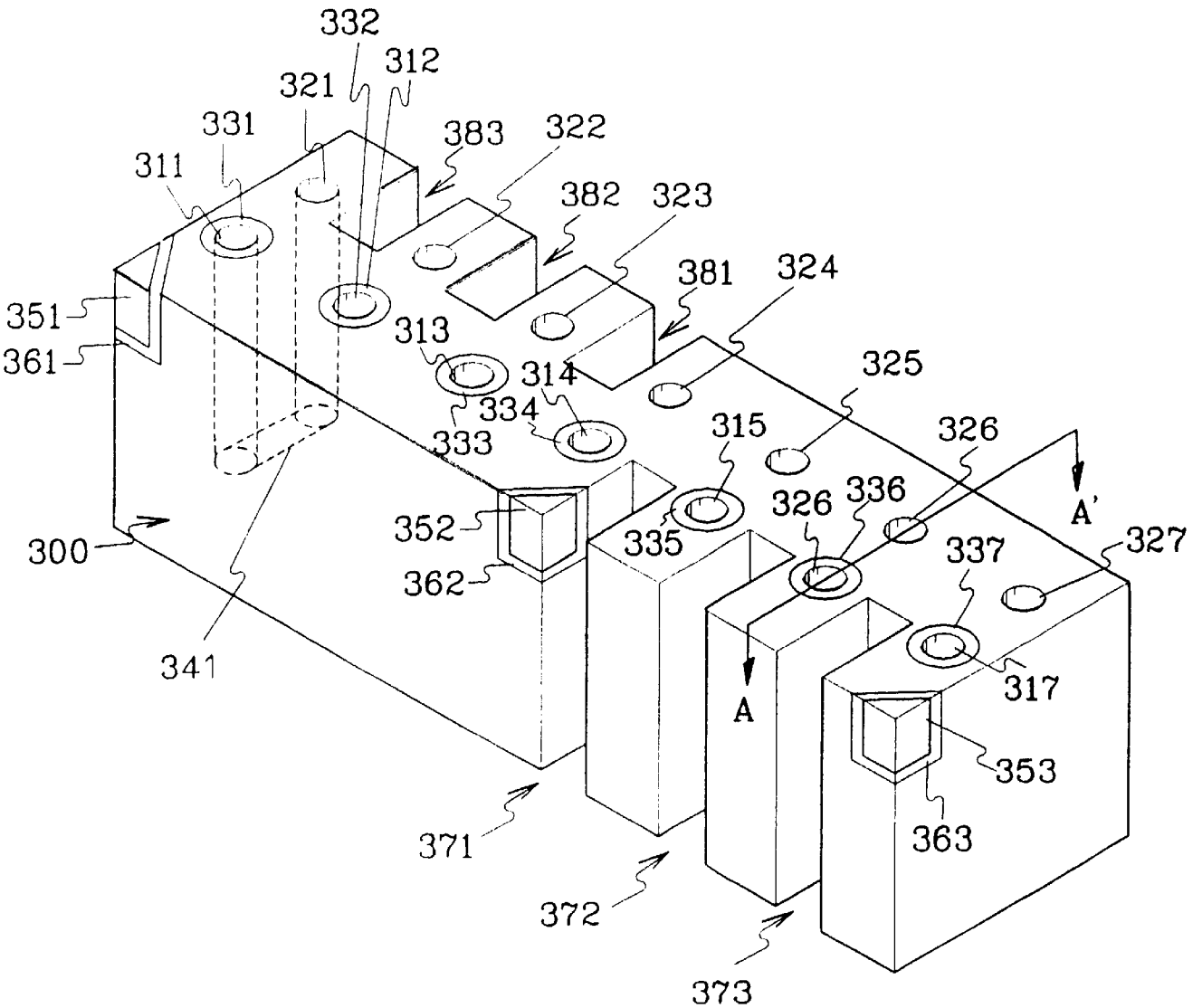
FIG. 4*a* is a perspective view illustrating a duplexer according to an embodiment of the present invention.

FIG. 4*a* is a perspective view illustrating a duplexer according to an embodiment of the present invention.

Referring to FIG. 4*a*, a dielectric block 300, which is coated with a conductive film (not shown), has resonance apertures and grooves 371 to 373 and 381 to 383. The grooves 371 to 373 are formed in the front side of the dielectric block 300 and the grooved 381 to 383 are formed in the rear side of the dielectric block 300, extending in a heightwise direction. A plurality of resonance apertures 311 to 317 and 321 to 327, which are formed from the upper surface of the dielectric block 300 to the bottom surface of the dielectric block 300, are arranged between the grooves 371 to 373 and 381 to 383. As other surfaces of the dielectric block 300, the inner surfaces of the resonance apertures 311 to 317 and 321 to 327 are also coated with the conductive film. On the bottom surface of the dielectric block 300, recesses 341 to 347 not shown are formed from the resonance apertures 311 to 317 to the adjacent resonance apertures 321 to 327, respectively, and are coated with the conductive film.

Further, the dielectric block 300 has a plurality of regions (gaps), which are not coated with the conductive film. In the dielectric block 300 according to the present invention, the gap (ring like uncoated regions) 331 to 337 is formed round the resonance apertures 311 to 317 on the upper surface of the dielectric block 300 in order that the conductive film on the inner surfaces of the resonance apertures 311 to 317 is not electrically coupled to the outer conductive film coated on the dielectric block 300, and such resonators are called open ended resonators. On the other hand, the conductive film on the inner surfaces of the resonance apertures 321 to 327 is electrically coupled to the outer conductive film coated on the dielectric block 300, which is called shorted resonators. Further, the dielectric block 300 has a gap 361 for preventing an input terminal 351 from being coupled to the conductive film, a gap 362 for preventing an antenna terminal 352 from being coupled to the conductive film, and a gap 363 for preventing an output terminal 353 from being coupled to the conductive film.

As stated above, the four sides, the upper surface of the dielectric block 300 are entirely coated with the conductive film, except the gap 331 to 337 and 361 to 363, and the bottom surface.

Figure 4B:
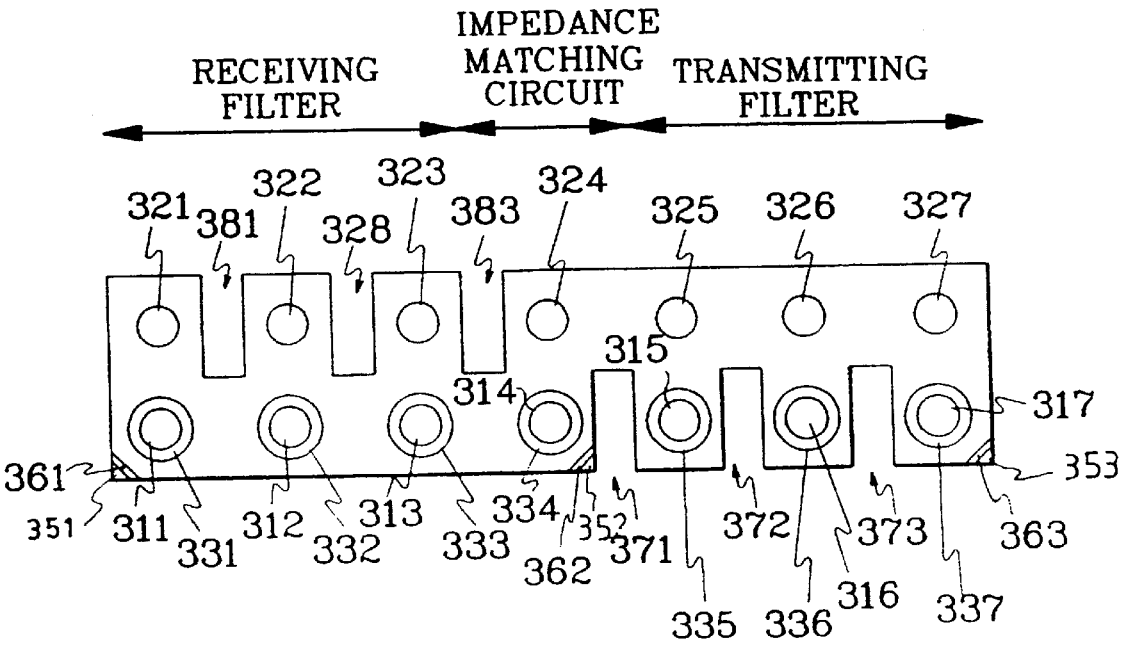
FIG. 4*b* is a top plane view of the duplexer of FIG. 4*a;*
Figure 4C:
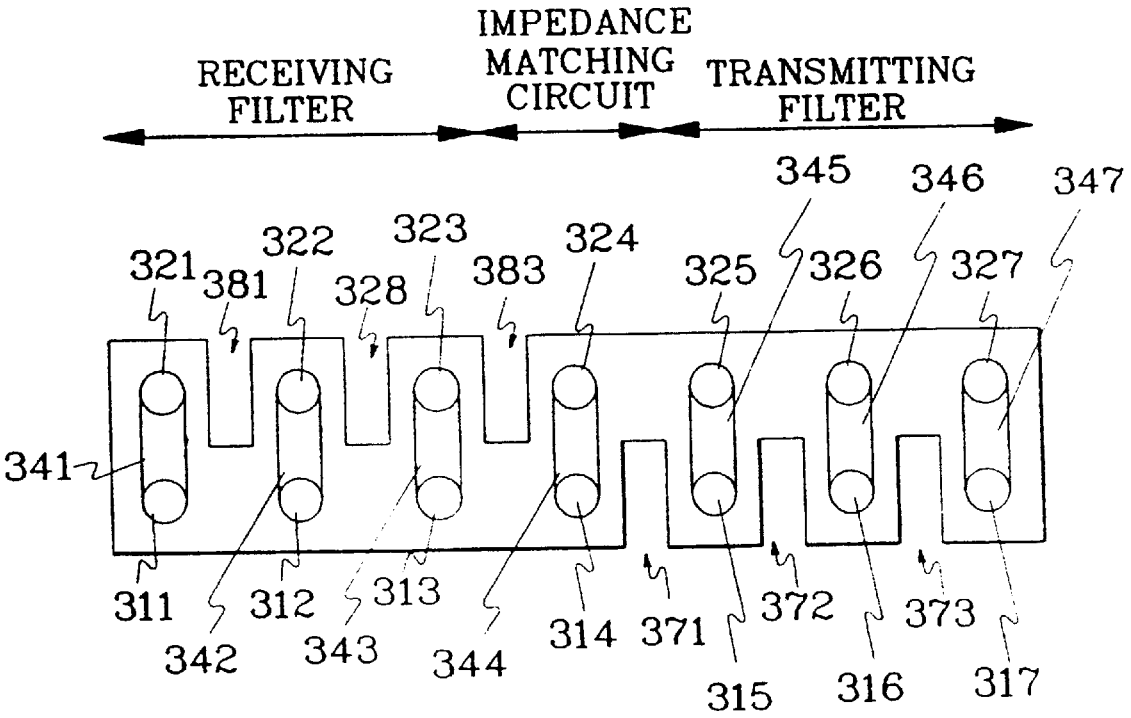
FIG. 4*c* is a bottom plane view of the duplexer of FIG. 4*a;*
Figure 4D:
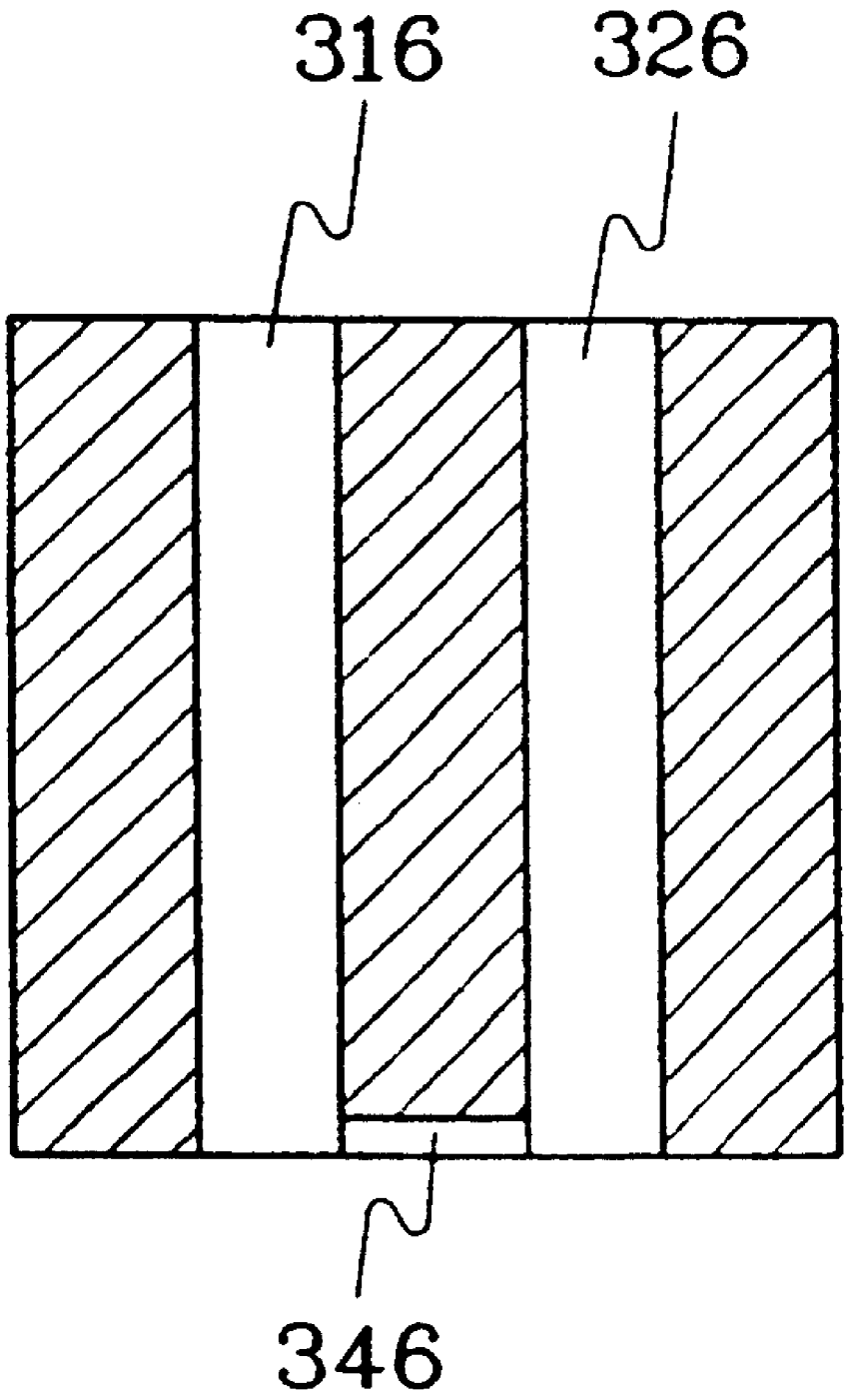
FIG. 4*d* is a cross-sectional view taken on line A–A' of FIG. 4*a;*

FIG. 4*b* is a top plane view of the duplexer of FIG. 4*a*, FIG. 4*c* is a bottom plane view of the duplexer of FIG. 4*a* and FIG. 4*d* is a cross-sectional view taken on line A–A' of FIG. 4*a*.

Referring to FIGS. 4*b* and 4*c*, the resonance apertures constitute open ended resonators 311 to 317, shorted resonators 321 to 327, and recesses 341 to 347. The open ended resonators 311 to 313, the shorted resonators 321 to 323, and recesses 341 to 343 form a receiving filter, the open ended resonators 315 to 317, the shorted resonators 325 to 327, and recesses 345 to 347 form a transmitting filter, and the open ended resonators 314 and the shorted resonators 324 and recess 344 form an impedance matching circuit between the receiving filter and the transmitting filter. As a result, the duplexer formed by the dielectric block 300, as shown in FIG. 4*a*, acts as resonators of ¼ wavelength.

The transmitting and receiving filters of the duplexer are made by forming two or more resonators in a dielectric block. Input and output terminals 351 and 353, which are respectively formed into a predetermined shape, are isolated from the conductive film with which the dielectric block is coated. Such isolation is implemented by the gaps 361 and 363.

Accordingly, a signals, which are received to the input terminal 353 of the transmitting terminal, are transferred to a first resonator 317. These signals transferred to the first resonator 317 are, in this order, transferred to adjacent resonators by means of the electromagnetic coupling which transfers the signals to an adjacent resonator. In this manner, the signals are transferred to the resonator for matching impedance with the antenna terminal so that the signals are output into the antenna terminal 352, but not the receiving terminal. Further, the signal input the antenna terminal is transferred to the receiving filter, but not the transmitting filter, by the impedance matching, such that the signals are transferred to the output terminal 351 of the receiving terminal.

At this time, the dielectric block acts as a duplexer having transmit-receive branching filters in a body, by forming coupling control grooves 371 to 373 and 381 to 383 between the resonators from the upper surface to the bottom surface and then controlling the coupling therebetween.

The ¼ wavelength resonator whose bottom end portion constitutes a short circuit has the highest electric field at its open side (non-conductive film region) and has the highest magnetic field at its shorted side (conductive film region). In the stepped impedance resonator having different impedance in the shorted side and open side, the coupling relationship between the resonators is expressed by odd even mode admittance, as follows:

$$\begin{bmatrix} -j\frac{1}{2}y_2\{B_o(f)+B_e(f)\} & -j\frac{1}{2}y_2\{B_o(f)-B_e(f)\} \\ -j\frac{1}{2}y_2\{B_o(f)-B_e(f)\} & -j\frac{1}{2}y_2\{B_o(f)+B_e(f)\} \end{bmatrix}$$

where, $y_2$ is odd admittance of open ended resonator;

$B_o(f)$ is susceptivity expressed using odd mode admittance; and $B_e(f)$ is susceptivity expressed using even mode admittance.

Accordingly, the attenuation characteristics may be improved at the rejection band which goes astray from the pass band, because the received signals are not transferred to the output terminal and flows into a ground level so that a pole in which the signal transmission is not made is generated at the frequency at which resonator's susceptivity using the odd mode admittance is equal to the that using the even mode admittance.

The duplexer, as shown in FIG. 4*a*, forms a stepped impedance resonator in which the characteristic impedance of the open ended resonators 311 to 317 is different from that of the shorted resonators 321 to 327. The highest electric field is achieved at the open ended resonators 311 to 317, the highest magnetic field is achieved at the shorted resonators 321 to 327, and the grooves 371 to 373 and 381 to 383 for controlling the coupling are formed between the resonators.

As shown in FIG. 4*b*, at the transmitting filter, the coupling between the resonators is the magnetic coupling since the grooves 371 to 373 for controlling the coupling are formed between the open ended resonators 314 to 317. Accordingly, the pole frequency at which signals are not transferred may be positioned at higher frequency than the pass band. This filter has excellent attenuation characteristics at the rejection band higher than the pass band.

Figure 6:
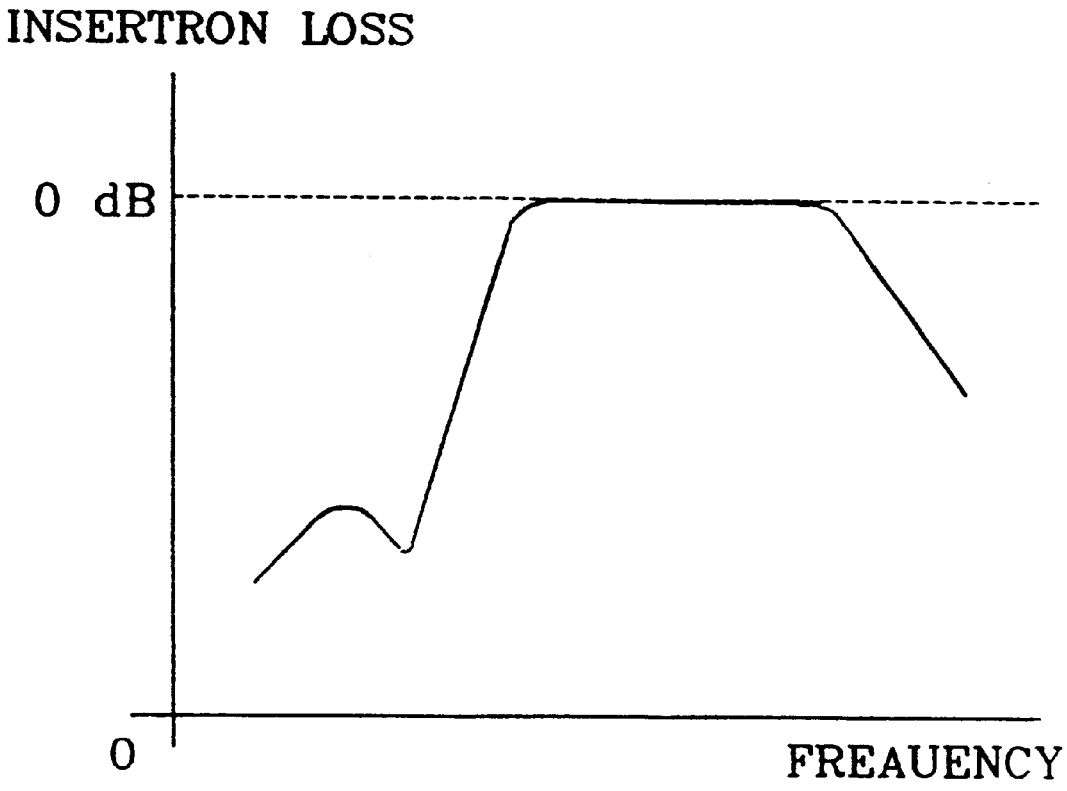
FIG. 6 is an insertion loss characteristic graph at transmitting and receiving terminals using the duplexer according to the prior art and the present invention.

Referring again to FIG. 4*b*, at the receiving filter, the coupling between the resonators is the electric coupling since the grooves 381 to 383 for controlling the coupling are formed between the shorted resonators 321 to 324. Therefore, as shown in FIG. 6, the pole frequency at which signals are not transferred may be positioned at lower frequency than the pass band.

By forming this duplexer having a small number of resonators, the receiving filter can obtain excellent attenuation characteristics at the transmitting frequency and the transmitting filter can also obtain excellent attenuation characteristics at the receiving frequency. Alternatively, the electric connection between the open ended resonators 311 to 317 and the shorted resonators 321 to 327 can be achieved by electric patterns instead of the recesses 341 to 347.

Figure 5A:
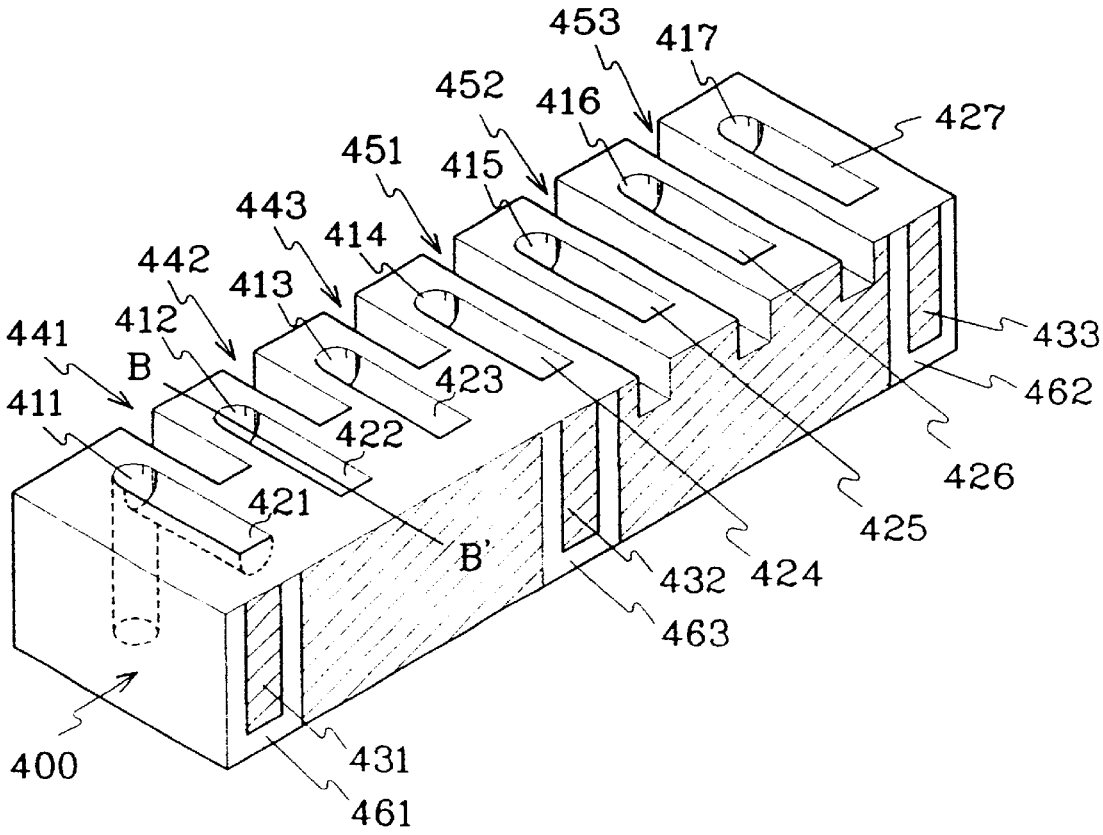
FIG. 5*a* is a perspective view illustrating a duplexer according to another embodiment of the present invention.
Figure 5B:
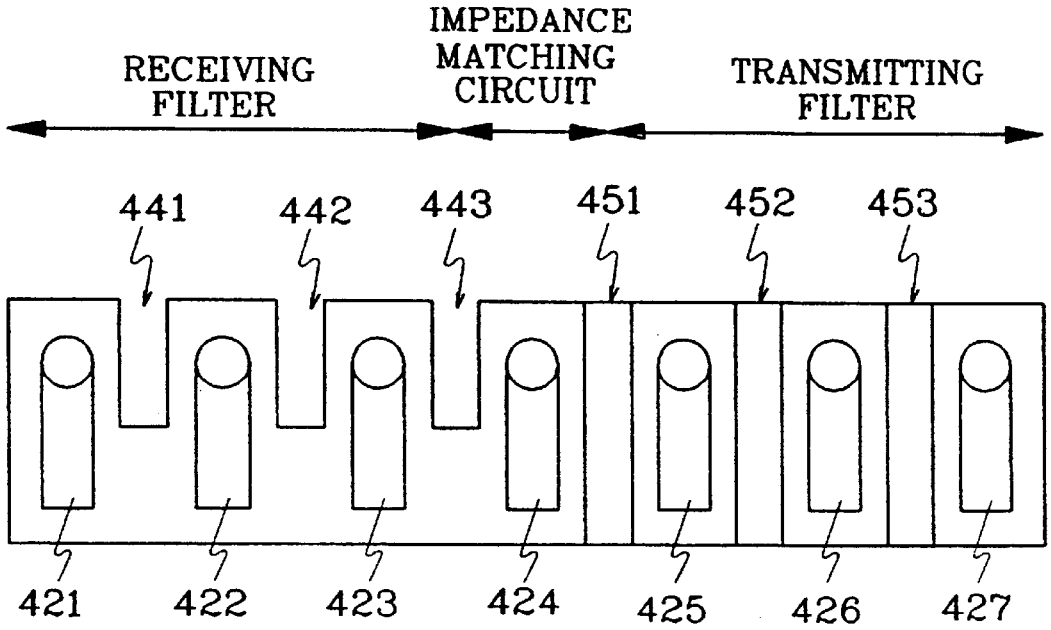
FIG. 5*b* is a top plane view of the duplexer of FIG. 5*a;*
Figure 5C:
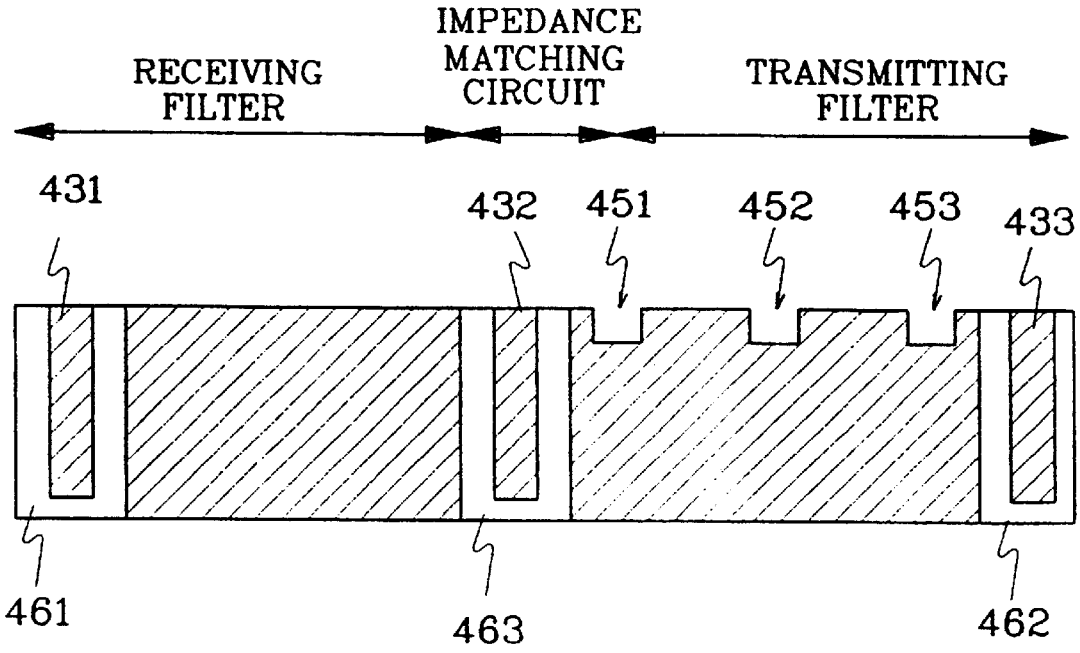
FIG. 5*c* is a front view of the duplexer of FIG. 5*a;*

FIG. 5*a* is a perspective view illustrating a duplexer according to another embodiment of the present invention. In addition, FIG. 5*b* is a top plane view of the duplexer of FIG. 5*a*, FIG. 5*c* is a front view of the duplexer of FIG. 5*a*, and FIG. 5*c* is a cross-sectional view taken on line B–B' of FIG. 5*a*.

All the surfaces of a dielectric block 400 are coated with a conductive film, except top plane and gaps 461 to 463 for preventing input/output terminals 431 and 433 and antenna terminal 432 from being electrically connected to the conductive film (or ground terminal). Resonators are implemented by apertures 411 to 417 and recesses 421 to 427. Likewise, the conductive film is coated on not only the inner surface of the apertures 411 to 417 but also the surface of the recesses 421 to 427, as on other surfaces expert for the gaps 461 to 463.

As a result, the apertures 411 to 417 extend in a heightwise direction from the upper surface to the bottom surface of the dielectric block so that each of the resonators is electrically coupled to the conductive film. On the other hand, the apertures 411 to 417 are electrically coupled to the recesses 421 to 427, respectively, at the upper surface of the dielectric block 400. The recesses 421 to 427 extend from the apertures 411 to 417 toward the front side of the dielectric block, but they don't reach to the edge in the upper open side of the resonators. At this time, the ends of the recesses 421 to 427 act as open ended sides. Therefore, the stepped impedance resonators, in which the characteristic impedance at the open ended resonator is different from that at the shorted end of the resonator, are constituted.

In the transmitting filter, grooves 451 to 453 for controlling the coupling are formed, in a widthwise direction, from the front side to the rear side of the dielectric block 400 between the resonators and cause the magnetic coupling to be produced between the resonators 414 to 417, so that the excellent attenuation characteristics may be obtained at the rejection band higher than the pass band. Also, in the receiving filter, by forming grooves 441 to 443 for controlling the coupling between the resonators from the upper surface to the bottom of the dielectric block, the coupling between the resonators is achieved due to the electric field, so that excellent attenuation characteristics may be obtained at rejection band lower than the pass band.

In the duplexer according to this embodiment of the present invention, the receiving filter improves the attenuation characteristics at transmitting frequency and the transmitting filter improves the attenuation characteristics at receiving frequency, by providing a small number of resonators. Furthermore, it is also possible to electrode patterns instead of the recesses 421 to 427.

Figure 5D:
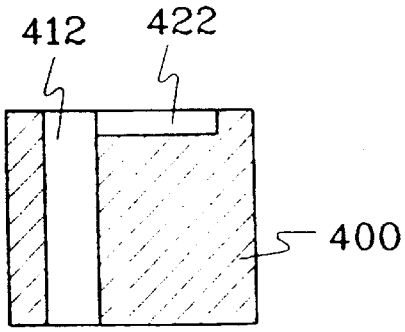
FIG. 5*d* is a cross-sectional view taken on line B–B' of FIG. 5*a*.

The duplexer according to the present invention may be miniaturized with the lightweight, by forming U-shaped (as shown in FIG. 4*d*) or crooked (as shown in FIG. 5*d*) resonators instead of straight resonators.

The coupling between the resonators is achieved by the electric field or the magnetic field, by forming grooves at the outer wall of the dielectric block. Also, the duplexer according to the present invention effectively produces a pole to prevent signals from being transferred at the rejection band, using the difference of the characteristic impedance between the open ended portion and the shored portion of the resonator. Further, the duplexer according to the present invention, without external chip capacitor or inductor, makes the transmitting filter have excellent attenuation characteristics at the rejection band higher than the pass band and makes the receiving filter have excellent attenuation characteristics at the rejection band lower than the pass band. The duplexer of the present invention has effect on simplification of the processes and cuts down manufacturing cost.

What is claimed is:

1. A duplexer having stepped impedance resonators which are formed in a dielectric block coated with a conductive film, wherein the duplexer includes a transmitting filter, a receiving filter and an impedance matching circuit, the duplexer comprising:

a) a plurality of open ended resonators arranged in a front side of the dielectric block, the open ended resonators includes:

a-1) a plurality of first apertures, each of which passes through the dielectric block from an upper surface thereof to a bottom surface thereof, wherein inner surfaces of the first apertures are coated with the conductive film; and a-2) a plurality of uncoated gaps round the first apertures on the upper surface of the dielectric block, b) a plurality of shorted resonators arranged in a rear side of the dielectric block, the shorted resonators includes:

b-1) a plurality of second apertures, each of which passes through the dielectric block from the upper surface thereof to the bottom surface thereof, wherein each shorted resonators corresponds to the open ended resonators and wherein inner surfaces of the second apertures are coated with the conductive film, c) a plurality of recesses formed at the bottom of the dielectric block, extending from the first apertures of the open ended resonators to the second apertures of the shorted resonators, wherein the recesses are coated with the conductive film, d) a plurality of first grooves for controlling receiving coupling at the receiving filter, each of which is formed in the rear side of the dielectric block at the receiving filter, wherein the first grooves are formed from the upper surface of the dielectric block to the bottom surface of the dielectric block; and e) a plurality of second grooves for controlling transmitting coupling at the transmitting filter, each of which is formed in the front side of the dielectric block at the transmitting filter, wherein the second grooves are formed from the upper surface of the dielectric block to the bottom surface of the dielectric block.

2. The duplexer in accordance with claim 1, wherein the first grooves are formed between the second apertures for electric coupling so that the first grooves improve attenuation characteristics at lower frequency than a pass band.

3. The duplexer in accordance with claim 1, wherein the second grooves are formed between the first apertures for magnetic coupling so that the second grooves improve attenuation characteristics at higher frequency than a pass band.

4. The duplexer in accordance with claim 1, wherein the recesses include electrode patterns.

5. A duplexer having stepped impedance resonators which are formed in a dielectric block coated with a conductive film, wherein the duplexer includes a transmitting filter, a receiving filter and an impedance matching circuit, the duplexer comprising:

a plurality of resonators arranged in a rear side of the dielectric block, wherein each resonators passes through the dielectric block from an upper surface thereof to a bottom surface thereof, wherein inner surfaces of the first apertures are coated with the conductive film;

a plurality of recesses formed at the upper surface of the dielectric block, extending from the resonators toward a front side of the dielectric block, a plurality of first grooves for controlling receiving coupling at the receiving filter, each of which is formed in an outer wall of the dielectric block and between the resonators, wherein the first grooves are formed from the upper surface of the dielectric block to the bottom surface of the dielectric block; and a plurality of second grooves for controlling transmitting coupling at the transmitting filter, each of which is formed in the upper surface of the dielectric block and between the resonators, wherein the second grooves are formed from the rear side of the dielectric block to a front side of the dielectric block.

6. The duplexer in accordance with claim 5, wherein the inner conductive film of the resonators is electrically coupled to the outer conductive film of the dielectric block, wherein the recesses are apart from an edge of the dielectric block and ends of the recesses is open ended side.

7. The duplexer in accordance with claim 5, wherein the first grooves are formed between the second apertures for electric coupling so that the first grooves improve attenuation characteristics at lower frequency than a pass band.

8. The duplexer in accordance with claim 5, wherein the second grooves are formed between the first apertures for magnetic coupling so that the second grooves improve attenuation characteristics at higher frequency than a pass band.

9. The duplexer in accordance with claim 5, wherein the recesses include electrode patterns.

* * * * *